United States Patent [19]

Craine

[11] 4,258,892

[45] Mar. 31, 1981

[54] PEG HOOK DISPLAY SUPPORTING APPARATUS

[75] Inventor: John C. Craine, Lombard, Ill.

[73] Assignee: Advertising Metal Display Company, Chicago, Ill.

[21] Appl. No.: 927,495

[22] Filed: Jul. 24, 1978

[51] Int. Cl.[3] ..... E04G 3/00

[52] U.S. Cl. ..... 248/220.4; 248/222.1

[58] Field of Search ..... 248/220.4, 221.1, 221.2, 248/221.3, 222.1, 680, 681, DIG. 5; 292/283, 343; 85/5 CP

[56] References Cited

U.S. PATENT DOCUMENTS

| | | | |
|---|---|---|---|
| 700,324 | 5/1902 | Gray | 292/343 |
| 908,143 | 12/1908 | Rosine | 292/343 |
| 1,095,368 | 5/1914 | Altman | 292/343 |
| 3,409,260 | 11/1968 | Bleed | 248/221.1 |
| 3,696,937 | 10/1972 | Braverman | 248/220.4 |
| 3,934,727 | 1/1976 | Brefka | 248/220.4 X |
| 4,105,179 | 8/1978 | Elliott | 248/221.2 |

*Primary Examiner*—William H. Schultz

*Attorney, Agent, or Firm*—Neuman, Williams, Anderson & Olson

[57] ABSTRACT

A peg hook and support bracket assembly is used for supporting items displayed on a perforated wall board of a type often marketed under the trademark PEG BOARD. The peg hook is U-shaped having a cross member, a pair of spaced apart L-shaped prongs extending at essentially right angles to the cross member and adapted for insertion into a pair of wall board perforations and an item supporting rod element connected to and extending centrally from the cross member. The support bracket cooperatively engages the peg hook by insertion between the prongs thereof to frictionally exert pressure between the cross member and the wall board surface when the peg hook is mounted thereon. The support bracket secures the item supporting rod element and maintains the peg hook in a stable position when the peg hook and bracket are mounted in the interlocked position on the perforated wall board.

15 Claims, 7 Drawing Figures

FIG. 1
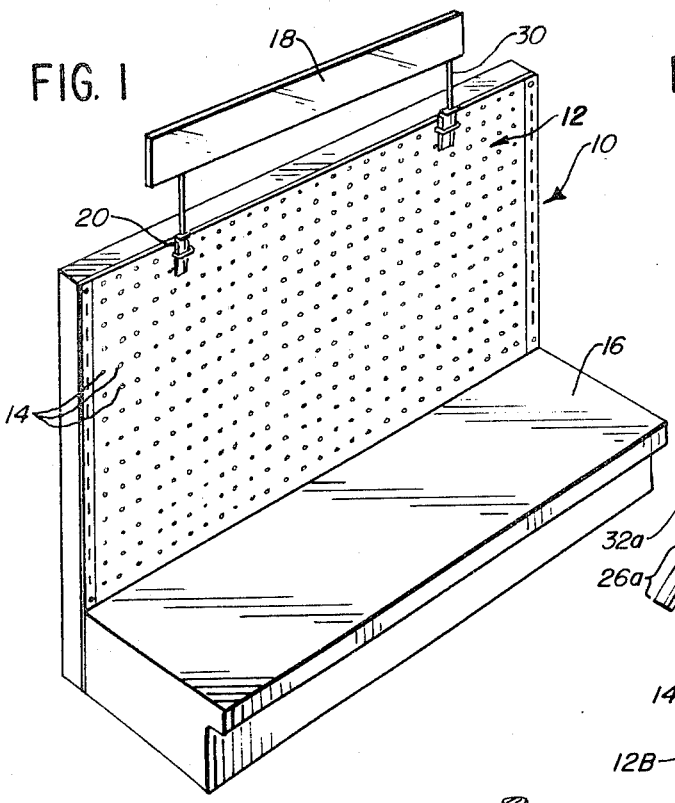
FIG. 4
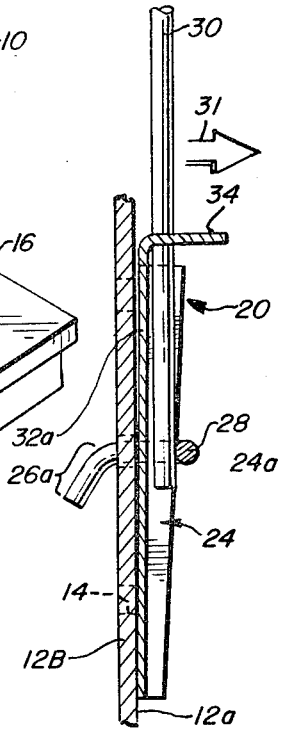
FIG. 3
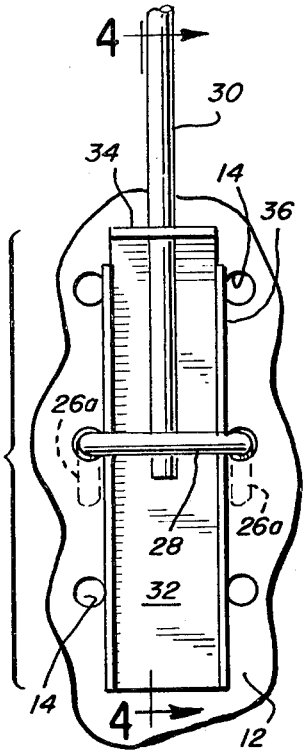
FIG. 5
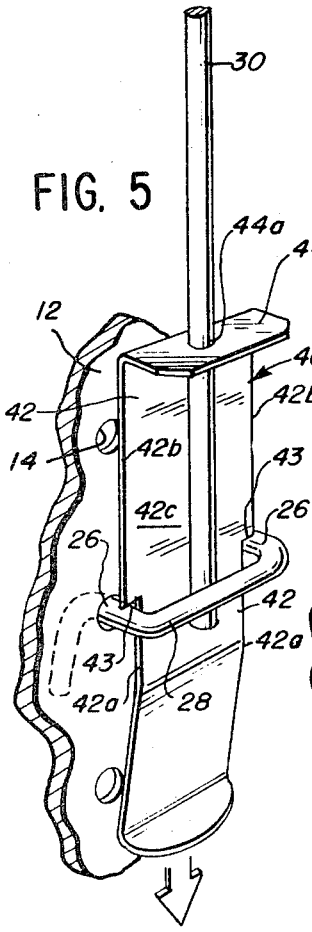
FIG. 2
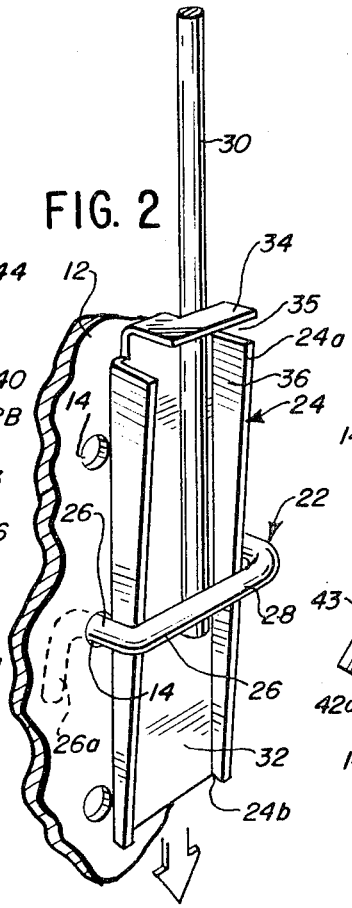
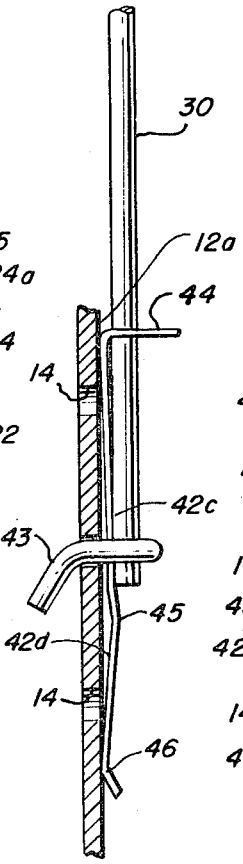
FIG. 7
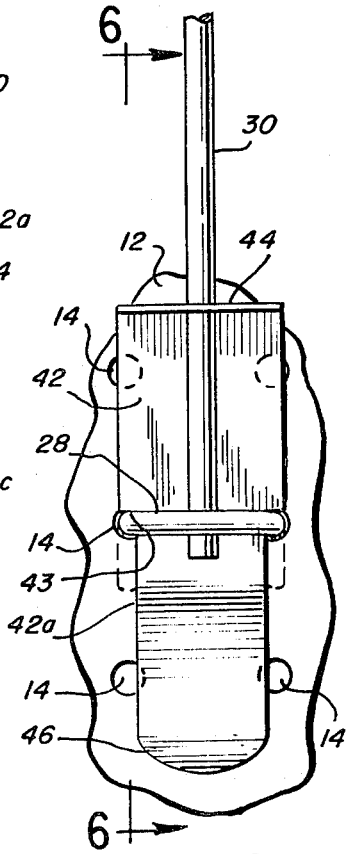
FIG. 6

PEG HOOK DISPLAY SUPPORTING APPARATUS

FIELD OF THE INVENTION

This invention relates to a removable peg hook apparatus for supporting and displaying goods or advertising on an apertured wall board of a type often marketed under the trademark PEG BOARD, and more particularly to a two-piece peg hook assembly adapted to provide a rigid display facility mountable on an apertured wall board.

DESCRIPTION OF THE PRIOR ART

Apertured wall boards are frequently used for displaying consumer goods or goods in conjunction with advertising in a point-of-purchase context in retail establishments. The goods are customarily displayed on or suspended from peg hooks which are adapted to be removably fitted in the regular apertures of the wall board surface which is installed in the retail establishment. While the apertured wall boards are usually standardized with respect to regularity of the holes or apertures, they frequently vary in thickness. For this reason it is especially desirable to devise a peg hook assembly to hold and secure such goods or displays on any apertured wall board, regardless of thickness. Various peg hook devices, including two-piece peg hooks, are known in the prior art.

For example, U.S. Pat. No. 3,339,871 discloses a two-piece peg hook which includes a U-shaped bracket wherein the legs of the U are adapted for fitting in the spaced-apart apertures of the wall board and the connecting portion of the U-shaped bracket defines a space for securing a rectangular portion of a horizontally extending display arm which is essentially normal to the surface of the wall board. The horizontal arm portion is adapted to hold the goods or cards carrying the goods.

U.S. Pat. No. 3,198,469 is a similar apparatus including a formed metal bracket having a pair of hooks for removable engagement with the apertures of the wall board and defining a mounting aperture depending downwardly from the hook elements and parallel to the board's surface. In this construction a removable arm, essentially L-shaped in configuration, has a base adapted to fit within the formed cavity of the bracket mounted on the board and an arm which extends outwardly and angularly to the board's surface for holding goods.

A similar apparatus for supporting and displaying merchandise is described in U.S. Pat. No. 3,976,201, which also includes two separate elements, namely, a securing bracket or clamp containing a pair of hooks for mounting engagement with the apertures of the wall board and a separate and removable display hanger element, generally in the shape of a hairpin wherein the termini of the legs are angularly bent to fit within the apertures of the bracket mounted on the board and provide a loop-shaped support to hold merchandise.

One of the difficulties with the prior art devices is that none of them are particularly adapted to fit apertured wall boards of varying thickness. Accordingly, it would be desirable to provide a peg hook assembly which could be adapted for use under such circumstances and still provide the necessary rigidity for holding goods and displays that is required for normal consumer use and the handling incident thereto and prevent accidental disengagement of the peg hook from the apertured board.

Furthermore, it would be desirable to provide removable peg hook elements which are adapted to hold advertising displays which extend above the vertical top edge of the apertured board surface in a secure and rigid fashion.

It is therefore a general object of the invention to provide an improved peg hook apparatus for supporting goods on displays from an apertured wall board that is simple in operation.

It is also an object of this invention to provide a removable peg hook apparatus for supporting a display on apertured wall boards of varying thicknesses.

It is a further object of this invention to provide an apparatus for supporting goods or display arm upwardly and in a substantially vertical position above the top edge of an apertured wall board.

Other objects and advantages of the invention will become apparent upon reading the following detailed description and appended claims, and upon reference to the accompanying drawings.

SUMMARY OF THE INVENTION

The present invention broadly comprises a peg hook securing and support bracket for use with a U-shaped peg hook having a pair of L-shaped prongs insertable in two perforations in a perforated wall board, the prongs being connected to a cross-member having a display holding rod element extending upwardly therefrom and parallel to the wall board surface when the hook is engaged therewith, said bracket comprising a generally rectangular base having a width to permit insertion between the prongs of the peg hook, means for sliding and securing engagement with the display holding rod element and means for urging the bracket between the cross-member of the peg hook and a perforated wall board surface wherein the peg hook is mounted to secure the peg hook to the board in an essentially non-removable position.

The invention also comprises the combination of a wall board having perforations in a spaced arrangement and a peg hook mounted in said perforations, and a peg hook securing and supporting bracket, said peg hook comprising a U-shaped hook having a pair of generally parallel L-shaped prongs extending from and connected to a cross-member and a display rod element connected to the cross-member and extending upwardly therefrom and parallel to the wall board surface when the hook is engaged therewith, said bracket having a generally rectangular base, being insertable between the prongs of said peg hook, having means frictionally engageable and exerting securing pressure on the wall board surface and the cross-member of the hook, and having means extending from one end of the bracket for engaging the display rod, securing it in an upright, non-rotatable position essentially parallel to the wall board surface.

BRIEF DESCRIPTION OF THE DRAWINGS

For a more complete understanding of this invention, reference should now be made to the embodiments illustrated in greater detail in the accompanying drawings and described below by way of examples of the invention.

FIG. 1 is a perspective view of a perforated wall board in a vertical position and illustrating the peg hook assembly of the present invention affixed thereon and supporting a displayed item;

FIG. 2 is an enlarged perspective view of the installed peg hook assembly illustrated in FIG. 1 mounted on the perforated wall board shown in partial section;

FIG. 3 is a front elevational view of the peg hook apparatus illustrated in FIG. 2;

FIG. 4 is a sectional view of the peg hook assembly taken along the lines 4—4 of FIG. 3;

FIGS. 5 and 6 are respectively perspective and front elevational views of another embodiment of the securing bracket of FIGS. 1–4 used in the peg hook assembly of this invention mounted on a perforated board shown in partial section;

FIG. 7 is a sectional view of the peg hook assembly taken along the line 6—6 of FIG. 6.

DETAILED DESCRIPTION OF THE DRAWINGS INCLUDING PREFERRED EMBODIMENTS

Referring to FIG. 1 of the drawings, there is illustrated a apertured board display rack 10 for displaying goods and/or advertising devices, comprising an apertured wall board 12 provided with a plurality of apertures or holes 14 formed therein. The display rack 10 is supported in a vertical position by a base 16 which, in turn, rests on a supporting surface such as a floor or counter. The apertures or holes 14 in the wall board surface are regularly spaced and typically separated by distances of ½ or 1 inch and sized to be compatible with the standardized peg hooks available to the display industry, customarily formed of steel rod. FIG. 1 also illustrates a display item 18 supported by the peg hook assembly apparatus of the present invention 20 mounted on the apertured wall board 12.

Referring to FIGS. 1 through 4, there is illustrated a preferred embodiment of the peg hook assembly 20 comprising a peg hook 22 and a securing and reinforcing bracket 24. The peg hook 22 is U-shaped, having a pair of generally parallel and complementary L-shaped prongs 26 connected by a cross-member 28. A segment of prongs 26 extend parallel to each other and perpendicularly from the ends of the cross-member 28 and extend downwardly at their ends 26*a* to define a hook element engageable with the rearward surface 12*b* of the wallboard 12 when the peg hook assembly 20 is mounted on the front surface 12*a* of the apertured wall board. As illustrated, the peg hook includes a display rod element 30 affixed to and extending perpendicularly and upwardly from the central portion of the cross-member 28 normal to a plane established by the cross-member and the portion of the L-shaped prong attached to the ends of the cross-member 28. The display rod element 30 of the peg hook 22 is parallel to and spaced from the wall board surface 12*a* when assembly 20 is mounted thereon as shown in FIGS. 1 through 4.

The removable securing and reinforcing bracket 24 illustrated comprises a generally rectangular base 32 having a lateral dimension or width to permit essentially sliding insertion in the space defined by the prongs 26 of the peg hook 22 and in the direction of the arrows in FIGS. 2 and 3.

The bracket 24 has a rod securing element 34 integrated with and extending from the upper or top end 32a of the base 32 adapted to slidably secure and hold the rod 30 in a vertical position, preventing rotation of the rod 30 in the direction of the arrow 31 shown in FIG. 4 away from the front surface 12*a* of the wall board 12 around the fulcrum established by the prongs 26 of peg hook 22 when the assembly is mounted in the holes of the apertured wall board. The bracket 24 is provided with a pair of tapered flanges 36 at the side edges thereof, which flanges 36 extend upwardly from and perpendicular to the base 32 of the bracket and form a pair of tapered parallel wedges which extend almost the length of the base 32 and have a larger dimension at the top end 24*a* tapering to a narrower dimension at the bottom end 24*b* of base 32. The tapered configuration and dimensions of the flanges are such that they conform to the space defined by wall board surface 12*a*, the cross-member 28 and the prongs 26 of hook 22 so that the flanges 36 of the bracket 24 are in frictional engagement with the hook member 22 and the bottom surface of the bracket is in close fitting, frictional engagement with the surface 12*a* of the wall board 12. The point of frictional engagement of hook 22 is at approximately the midpoint of bracket 24 and such that the securing element 34 provides the required mechanical restraint to resist the rotation of the rod 30, as noted above, and prevent disengagement of the prong ends 26*a* of the U-shaped peg hook 28 from the holes 14 in the board 12.

The rod securing element 34, as illustrated in FIG. 2, is generally an L-shaped tab which extends upwardly and outwardly from a side edge of the base 32 in the same direction as the flanges 36 and is spaced from and across the base 32. The flanges 36 terminate at a point adjacent the top end of the base, providing a space 35 between securing element 34 and one flange 36 which is sufficient to permit insertion of rod 30 in the assembly of the bracket 24 with the hook 22 preparatory to mounting on a board. In mounting the hook 22 the prongs 26 are inserted in the holes 14 with bracket 24 removed from between the prongs 26. When prongs 26 are inserted as shown, the bracket 24 is dropped down into the space between the cross-member 28 and prongs 26 of hook 22 and the board surface 12a and forced down to provide a friction fit. This both secures the hook 22 and also takes up any slack which exists between hook 22 and surface 12*a* of the board 12.

FIG. 5 illustrates an alternative bracket embodiment 40 of the bracket 24 illustrated in FIGS. 1 through 4. The bracket 40 of FIGS. 5–7 comprises a generally rectangular base 42 provided with a rod securing element 44 at the top end thereof. The lateral sides 42*a* of the bracket 40 are dimensioned to provide sliding and fitting engagement with the space defined by the prongs 26 of the peg hook 22. The bracket 40 is provided with a pair of parallel extensions 42*b* which extend laterally from the base 42 coplanar therewith and outwardly from the lower side edges 42*a*. The lateral extensions 42*b* form with side edges 42*a* a pair of shoulders or detents 43 in about the midpoint of the bracket length which rest on the upper surface of the prongs 26 and prevent the bracket from dropping through the hook 22. The base 42 of bracket 40 is generally flat but is provided with an inward angular bend 45, at a point slightly below the retaining detents 43 and a second outward bend 46 adjacent the lower or bottom end of the bracket 40, both at minor acute angles of about 10° or less. The bracket 40 is formed of spring steel and the set of the spring at the point 45 is such that the upper surface 42*c* of the base 42 is in close fitting, frictional engagement with the inner surface of the display rod element 30 of the U-shaped peg hook 22 and the bottom face 42*d* of base 42 is in contact with the front surface 12a of the wall board 12 at the upper end of the bracket and at the point of engagement at the second bend 46. Thus, the bracket 40 is generally formed to provide a preset, flat spring which provides frictional engagement between the peg hook 22 and the wall board surface 12*a* to secure the peg hook prongs 26 in the holes 14 and take up any slack that would exist in the particular peg hook employed by virtue of the length of the prongs 26 established by the distance between the cross-member 28 and hooks 26*a*. As in the case of bracket 24, bracket 40 also permits the use of peg hooks 22 and prongs 26 which are adapted for use with apertured wall boards of varying thicknesses.

The rod retaining element 44 of bracket 40, as shown in FIG. 5, comprises a tab which is bent forwardly and outwardly from surface 42*c* of the base 42 and is provided with a centrally located and formed aperture or hole 44*a*. In the drawings, the rod element 30 of hook 22 is shown as a straight or vertical rod which is adapted to support or carry an advertising or identification sign or item 18 mounted at the top end thereof. To assemble the peg hook and reinforcing and securing bracket 40 that is illustrated in FIGS. 5, 6 and 7, it is necessary to thread the rod 30 through the aperture 44*a* formed in the tab 44 of the bracket 40. However, it is also possible to substitute a rod holding and securing element such as 34 shown in FIG. 2 in lieu of the apertured tab 44 shown in FIG. 5 which would provide ease of assembly without the necessity of removing a sign or display 18 from the rods 30 prior to mounting the display on a perforated wall board surface or the threading procedure described above.

It should be also understood that the rod 30 of peg hook 22, although shown as perpendicular to cross bar 28 and parallel to surface 12*a* when mounted on board 12, may also be formed to extend outwardly of surface 12*a* to form an extending arm for holding goods or packages or cards containing small items of merchandise such as blister packs or the like.

The peg hook apparatus of the present invention described above is adaptable for use with a variety of apertured wall boards, particularly apertured wall boards of varying thicknesses. While peg hooks are customarily designed with prong or hook arms for a particular thickness of apertured board, the apparatus of the present invention permits the designing of a hook with prongs of sufficient length to be used with boards of various thicknesses and still obtain a secure mounting element for display of goods.

The present invention also permits locking of the peg hook to the board surface and provides a display holding element which is not easily dislodged during normal use by customers or users who remove the goods from the display hooks.

Finally, the present invention provides a mounting device for pegboard displays which extends upwardly of the top edge of the apertured wall board, particularly advertising or other identifying signs or indicia.

What is claimed is:

1. A peg hook and support bracket assembly for use with a perforated wall board comprising:

(a) a U-shaped peg hook having a cross-member, a pair of spaced apart L-shaped prongs extending at essentially right angles to said cross-member and adapted for insertion into a pair of wall board perforations and an item supporting rod element connected to and extending centrally from the cross-member; and (b) a support bracket for cooperative interlocking engagement with the peg hook, said bracket comprising a generally rectangular base having a width to permit insertion between the prongs of the peg hook, pressure exerting means frictionally engageable with the cross-member and with a wall board surface when the peg hook is mounted thereon, and rod securing means extending from one end of the base for sliding and securing engagement with the rod element resisting rotational disengagement of the peg hook from a perforated wall board when the peg hook and bracket are mounted in the interlocked, frictionally secured position thereon.

2. The peg hook assembly of claim 1 wherein said prongs extend parallelly from and are integrally formed with the ends of the cross-member.

3. The peg hook assembly of claim 1 wherein said item-holding rod element is in a plane essentially parallel to the plane established by the base of the L-shaped prongs.

4. The peg hook assembly of claim 1 wherein said item-holding rod element extends essentially parallel to and spaced from the wall board surface.

5. The peg hook assembly of claim 1 wherein said prongs extend perpendicularly and downwardly from the ends of said cross member to define a hook element engageable with the rearward surface of the wall board when the peg hook assembly is mounted on the front surface of the wall board, and said display rod element extends perpendicularly and upwardly from the central portion of said cross member normal to a plane established by said cross member and the portion of the prongs attached to the ends of said cross member.

6. The peg hook assembly of claim 1 wherein said securing means for engaging said display rod element maintain the display rod in a position substantially parallel to the wall board surface.

7. The peg hook assembly of claim 6 wherein the securing means for engaging the display rod element are affixed to and extend from the top end of said bracket.

8. A peg hook and support bracket assembly for use with a perforated wall board comprising:

(a) a U-shaped peg hook having a cross-member, a pair of spaced apart L-shaped prongs extending at essentially right angles to said cross-member and adapted for insertion into a pair of wall board perforations and an item supporting rod element connected to and extending centrally from the cross-member and;

(b) a support bracket for cooperative interlocking engagement with the peg hook, said bracket comprising a generally rectangular base having a width to permit insertion between the prongs of the peg hook, pressure exerting means frictionally engageable with the cross-member and with a wall board surface when the peg hook is mounted thereon, and rod securing means extending from one end of the base for sliding and securing engagement with the rod element resisting rotational disengagement of the peg hook from a perforated wall board when the peg hook and bracket are mounted in the interlocked, frictionally secured position thereon, said securing means comprising a centrally apertured tab which is bent forwardly and outwardly from the front surface of said base of said bracket through which said rod element is inserted and in which said rod element is secured.

9. The peg hook assembly of claim 1 wherein said means for slidably engaging said display rod element comprise an L-shaped tab which extends forwardly and outwardly from said base of said bracket and is provided with a space in which said display rod element is inserted and secured.

10. A peg hook and support bracket assembly for use with a perforated wall board comprising:

(a) a U-shaped peg hook having a cross-member, a pair of spaced apart L-shaped prongs extending at essentially right angles to said cross-member and adapted for insertion into a pair of wall board perforations and an item supporting rod element connected to and extending centrally from the cross-member; and (b) a support bracket for cooperative interlocking engagement with the peg hook, said bracket comprising a generally rectangular base having a width to permit insertion between the prongs of the peg hook; pressure exerting means frictionally engageable with the cross-member and with a wall board surface when the peg hook is mounted thereon, and rod securing means extending from one end of the base for sliding and securing engagement with the rod element resisting rotational disengagement of the peg hook from a perforated wall board when the peg hook and bracket are mounted in the interlocked, frictionally secured position thereon, said pressure exerting and frictionally engaging means comprising a pair of tapered flanges extending upwardly from and perpendicular to said base of said bracket and located at the side edges thereof, said flanges extending substantially the length of the base and having a larger dimension their top ends and tapering to a narrower dimension at their bottom ends, thereby forming a pair of tapered parallel wedges, said wedges having dimensions which permit said bracket to be insertable between said prongs of said peg hook and to be frictionally engaged between said peg hook and the surface of said wall board when the peg hook is mounted thereon.

11. A peg hook and support bracket assembly for use with a perforated wall board comprising:

(a) a U-shaped peg hook having a cross-member, a pair of spaced apart L-shaped prongs extending at essentially right angles to said cross-member and adapted for insertion into a pair of wall board perforations and an item supporting rod element connected to and extending centrally from the cross-member; and (b) a support bracket for cooperative interlocking engagement with the peg hook, said bracket comprising a generally rectangular base of flat spring metal having a width to permit insertion between the prongs of the peg hook and a pair of parallel, lateral extensions centrally located on the side edges thereof and engageable with the upper surface of said prongs, said base being formed with a centrally located bend below said lateral extensions with a lower portion of the base extending downwardly and rearwardly of the bend such that said bracket exerts pressure to frictionally engage the base with said cross-member and with said wall board when the peg hook is mounted thereon, said support bracket further comprising rod securing means extending from one end of the base for sliding and securing engagement with the rod element resisting rotational disengagement of the peg hook from a perforated wall board when said peg hook and bracket are mounted in the interlocked, frictionally secured position thereon.

12. In combination with a wall board having a plurality of perforations in regularly spaced arrangement, a peg hook assembly mounted in the perforations of said wall board comprising a peg hook and a peg hook securing and support bracket wherein said peg hook comprises a cross member, a pair of L-shaped prongs extending from the cross member in securing engagement with perforations in said wall board and a display rod element connected to said cross member and extending upwardly therefrom, and wherein said peg hook securing and support bracket comprises a base insertable between said prongs of said peg hook when the latter is in the mounted position, frictionally engaged with and exerting hook securing pressure on the wall board surface and the peg hook preventing disengagement of said peg hook from said wall board, and means on the top portion of said bracket slidably engageable with the display rod element and securing it in an upright, nonrotatable position.

13. The combination of claim 12 wherein said cross member is a rod, said prongs extend perpendicularly from the ends of said cross member downwardly at their ends to define a hook element engaged with the rearward surface of the wall board when inserted therein, and said display rod element extends perpendicularly and upwardly from the central portion of said cross member normal to a plane established by said cross member and the portion of the prongs attached to the ends of said cross member.

14. The combination of claim 12 wherein said means for slidably engaging said display rod element comprise an apertured tab extending forwardly and outwardly from the front surface of the base of said bracket through which aperture said display rod element is insertable and secured.

15. The combination of claim 12 wherein said means for slidably engaging said display rod element comprises an L-shaped tab which extends forwardly and outwardly from the front surface of the base of said bracket to define a space for securing said display rod element.

* * * * *

UNITED STATES PATENT AND TRADEMARK OFFICE

CERTIFICATE OF CORRECTION

PATENT NO. : 4,258,892

DATED : March 31, 1981

INVENTOR(S) : John C. Craine

It is certified that error appears in the above-identified patent and that said Letters Patent are hereby corrected as shown below:

Under "References Cited" on face page, third reference of "U.S. PATENT DOCUMENTS" [56]

1,095,368 5/1914 Altman ..... 292/343 -- should read --

1,095,368 5/1914 Altman ..... 248/343

Signed and Sealed this

*Twenty-first* Day of *July 1981*

[SEAL]

*Attest:*

GERALD J. MOSSINGHOFF

*Attesting Officer*

*Commissioner of Patents and Trademarks*